US010624430B1

(12) United States Patent
Godwin, III et al.

(10) Patent No.: US 10,624,430 B1
(45) Date of Patent: Apr. 21, 2020

(54) STORAGE AND CARRYING CASE

(71) Applicant: CRED HOLDING COMPANY, Los Angeles, CA (US)

(72) Inventors: Edward Bradley Godwin, III, Riverside, CA (US); Edward Willis Harmon, IV, Riverside, CA (US); Jason DeFrancesco, Aptos, CA (US)

(73) Assignee: CRED HOLDING COMPANY, Los Angeles, CA (US)

( * ) Notice: Subject to any disclaimer, the term of this patent is extended or adjusted under 35 U.S.C. 154(b) by 0 days.

(21) Appl. No.: 16/284,990

(22) Filed: Feb. 25, 2019

(51) Int. Cl.

| | |
|---|---|
| ***B65D 85/28*** | (2006.01) |
| ***A45C 13/00*** | (2006.01) |
| ***A24F 15/12*** | (2006.01) |
| ***B65D 43/16*** | (2006.01) |
| ***A45C 11/00*** | (2006.01) |

(52) U.S. Cl.
CPC ..... *A45C 13/005* (2013.01); *A24F 15/12* (2013.01); *A45C 11/008* (2013.01); *B65D 43/165* (2013.01)

(58) Field of Classification Search
CPC ... B65D 43/165; A45C 11/008; A45C 13/005; E05D 11/105
USPC ..... 206/379; 16/233
See application file for complete search history.

(56) References Cited

U.S. PATENT DOCUMENTS

| | | | | |
|---|---|---|---|---|
| 6,913,143 | B2 * | 7/2005 | Yang | A45C 11/34 206/371 |
| 7,188,726 | B2 * | 3/2007 | Lin | B25H 3/003 206/373 |
| 8,898,862 | B1 * | 12/2014 | McGrath | E05D 11/1007 16/326 |
| 9,669,140 | B2 * | 6/2017 | Paradise | A61M 1/062 |
| 2005/0161356 | A1 * | 7/2005 | Chen | B25H 3/003 206/373 |
| 2007/0034637 | A1 * | 2/2007 | Carmichael | A45C 13/007 220/835 |
| 2012/0261042 | A1 * | 10/2012 | Khubani | A45C 1/06 150/143 |
| 2015/0068942 | A1 * | 3/2015 | Gerstner | A61B 50/30 206/370 |

FOREIGN PATENT DOCUMENTS

| | | | |
|---|---|---|---|
| GB | 408603 | A | 4/1934 |
| GB | 1042000 | A | 9/1966 |

OTHER PUBLICATIONS

International Search Report, PCT/US2019/019444, International Filing Date: Feb. 25, 2019, Applicant: Cred Holding Company, dated May 7, 2019.
Written Opinion of International Searching Authority, PCT/US2019/019444, International Filing Date: Feb. 25, 2019, Applicant: Cred Holding Company, dated May 7, 2019.

* cited by examiner

*Primary Examiner* — King M Chu
(74) *Attorney, Agent, or Firm* — Flener IP & Business Law; Zareefa B. Flener; Ayhan E. Mertogul

(57) ABSTRACT

A storage and carrying case comprises an upper housing and a lower housing connected by a locking hinge mechanism.

10 Claims, 5 Drawing Sheets

STORAGE AND CARRYING CASE

FIELD OF THE INVENTION

The present invention relates to a storage and carrying case. More specifically, the present invention relates to a storage and carrying case having a magazine for supporting and storing items and a housing having a locking hinge mechanism.

BACKGROUND

Hand rolled cigarettes are popular amongst smokers who prefer a particular sort of loose tobacco or other smokable product. Since hand rolled cigarettes are typically rolled by the smoker from rolling paper and loose tobacco product, the hand rolled cigarettes do not have an associated package, for example, like the package for a conventionally manufactured pack of cigarettes. With the advent of e-cigarettes, there has been created a variety of e-cigarette known as a pre-roll that is frustoconical in shape. Given the variety of flavors currently available for e-liquids vaporized in e-cigarettes, it has become common for users to carry multiple pre-rolls or other types of e-cigarettes.

Whether the user smokes factory manufactured cigarettes, hand rolled cigarettes, cigarillos, cigars, pre-rolls, or other types of e-cigarettes including without limitation vaporizers, e-pens, vaporization devices, vapers, or any other device for production of vapor or smoke as may be known in the art (hereinafter collectively referred to as "cigarettes"), carrying or storing them without an associated package without crushing, tearing, or otherwise damaging them can be a problem. For example, individual cigarettes carried or stored outside of a case can be damaged by exposure to excessive moisture, by the cigarettes drying out, or by being dropped, bent, or otherwise crushed or mangled.

Similarly, there is often a desire to carry a plurality of lip sticks, moisturizers, and/or glosses; mascaras; eyeliners; and other cosmetics, be they of the same or different colors, uses, brands, and styles. Also packages of candies, confectionaries and/or chocolates are commonly packaged in one container, whether the same or assorted in flavor and/or color and/or type. Edible items can be crushed or dry out, for instance chocolates filled with liquid or liqueurs or eyeliners.

Therefore, a need exists for a carrying case for items such as cigarettes of all types, for cosmetics, and edible items such as candies or chocolates, any of which could be crushed or could dry out. Items that are different could be stored together or items that are the same could be stored neatly together. It would be beneficial for the carrying case to have an internal magazine to support the items and a mechanism that locks the case closed. It would also be beneficial for the carrying case to have a seal that locks out moisture when the case is locked closed.

SUMMARY OF THE INVENTION

According to one aspect of the invention, a storage and case comprises an upper housing and a lower housing connected by a locking hinge mechanism.

According to another aspect of the invention, a storage and case comprises an upper housing and a lower housing connected by a hinge mechanism, and an internal magazine that supports one or more item.

According to a further aspect of the invention, a storage and carrying case comprises an upper housing and a lower housing connected by a locking hinge mechanism, and an internal magazine that supports one or more item.

BRIEF DESCRIPTION OF THE DRAWINGS

Other aspects and advantages of the present invention will become apparent upon consideration of the following detailed description, wherein similar structures have similar reference numerals.

DETAILED DESCRIPTION

The following detailed embodiments presented herein are for illustrative purposes. That is, these detailed embodiments are intended to be exemplary of the present invention for the purposes of providing and aiding a person skilled in the pertinent art to readily understand how to make and use of the present invention. Throughout the application, use of the term "item" could include any of a cigarette, candy, chocolate, confectionary, food, and cosmetics, without limitation. Furthermore, throughout the application, use of the term "cigarette" includes hand-rolled cigarettes (hand rolled using rolling papers), factory manufactured cigarettes, and/or e-cigarettes including without limitation pre-rolls, vaporizers, e-pens, vaporization devices, vapers, or any other device for production of vapor or smoke as may be known in the art and further including any such cigarette with or without nicotine, with or without cannabis products, with or without essential oils, and with or without CBD. The storage case may also be used for items other than cigarettes (as defined and understood) such as, but not limited to, cosmetics, candy, confectionary, edible products, and chocolate. For instance, cosmetics could include trial or smaller sized items that utilize wands such as mascara, lip or eye pencils. It is anticipated that even lip moisturizers could be stored in the storage case including, but not limited to, lip gloss, lip stain, and lip stick.

The storage and carrying case may also be referred to as a carrying case, a storage case, or even a storage carrying case.

Figure 1:
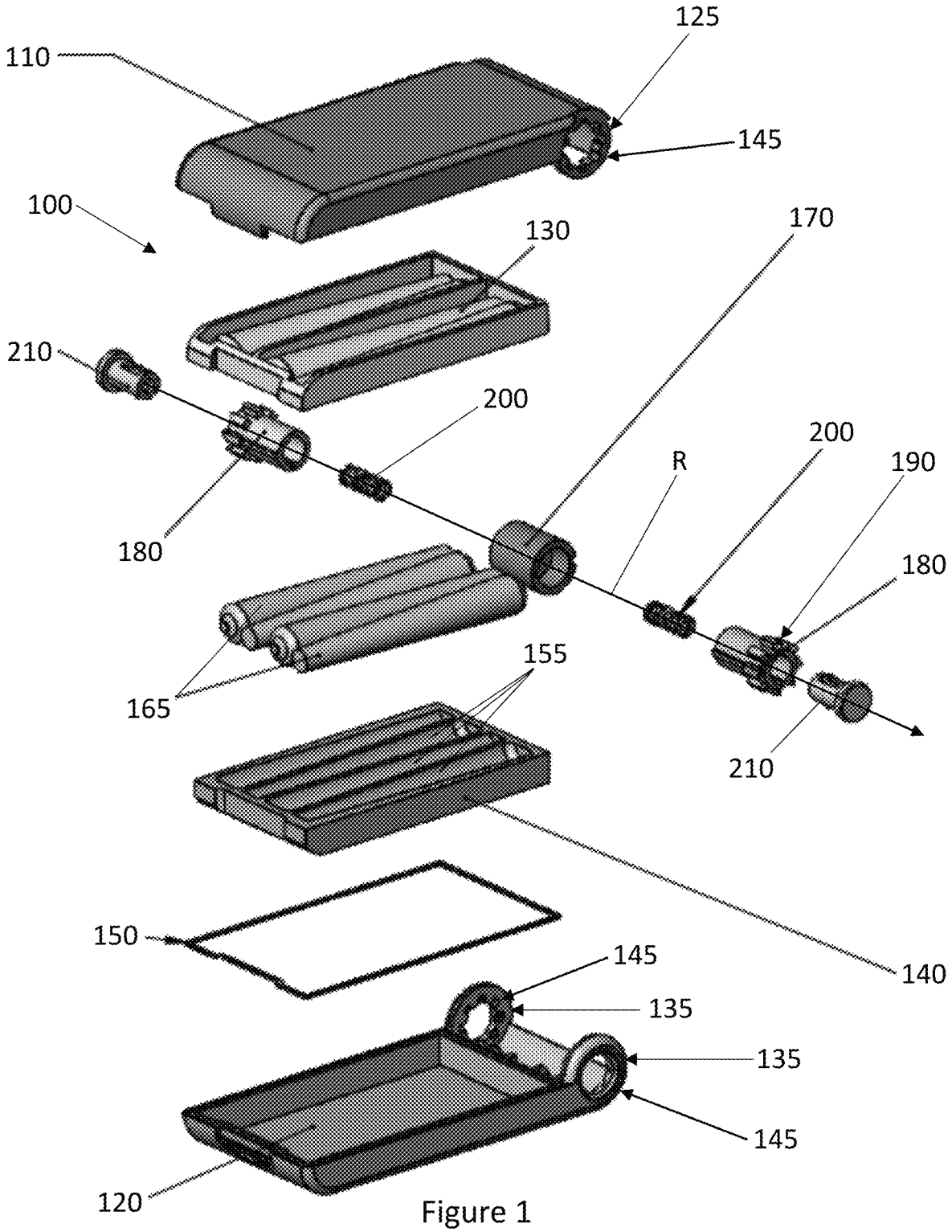
FIG. 1 is an exploded view of a first embodiment of a storage and carrying case.

An exploded view of a first embodiment of a storage and carrying case 100 is shown in FIG. 1. The carrying case 100 comprises an upper housing 110 and a lower housing 120. The upper housing 110 comprises at least one upper ring 125 disposed at an end thereof. Similarly, the lower housing 120 comprises at least one lower ring 135 disposed at an end thereof. In one embodiment when assembled the at least one upper ring 125 is lined up with and disposed on an interior side of the at least one lower ring 135; however, in other embodiments when assembled the at least one upper ring 125 is disposed on an exterior side of the at least one lower ring 135.

Each of the at least one upper rings 125 and the at least one lower rings 135 comprises slots 145 disposed around an interior surface thereof. The slots 145 disposed on the one of the at least one upper ring 125 and the at least one lower ring 135 that is on the exterior side when the upper and lower housings 110, 120 are assembled are disposed only partially through the one ring. For example, the slots 145 shown on the lower housing 120 in FIG. 1 extend from an interior side of the at least one lower ring 135 only partway through the at least one lower ring 135.

Although FIG. 1 illustrates two lower rings 135 and implies two upper rings 125 by the exploded structure of a hinge mechanism 160 (see below for further description), only one upper ring 125 and one lower ring 135 are required for the invention to operate as described herein. In an embodiment having only one upper ring 125 and one lower ring 135, alternative structures on an opposite side of the upper and lower housings 110, 120 could be rings or plates or any other structure as known in the art suitable to allow relative rotation between the upper and lower housings 110, 120 around the hinge mechanism 160.

In one embodiment, an upper magazine insert 130 is disposed within the upper housing 110 and a lower magazine insert 140 is disposed within the lower housing 120. Each of the upper and lower magazine inserts 130, 140 are held in place by an interference fit, by adhesive, by material welding, or by any other method of attachment as may be known in the art. In one embodiment, a sealing material 150, for example without limitation, a silicone gasket, is disposed around a perimeter of an open side of at least one of the upper housing 110 and the lower housing 120. The sealing material 150, may be fixed in place by an adhesive, by direct bonding onto the perimeter, or by any suitable method for attachment as may be known in the art.

In this embodiment, each of the upper and lower magazine inserts 130, 140 are configured to have a plurality of elongate grooves 155 that supports one or more item 165 along the length of the one or more item 165. The plurality of elongate grooves 155 are illustrated to be frustoconical to match the shape of the one or more item 165 shown. However, in another embodiment, the plurality of elongate grooves 155 are cylindrical.

Figure 2:
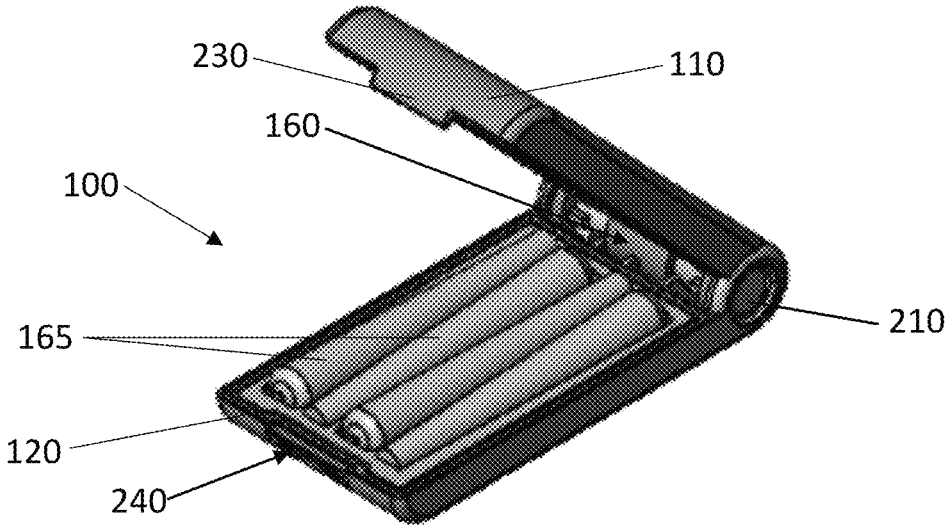
FIG. 2 is a perspective view of the first embodiment of the storage and carrying case in an open configuration.

The upper housing 110 and the lower housing 120 are connected by the hinge mechanism 160 that is shown assembled in FIG. 2 and exploded into its components in FIG. 1. Referring to FIG. 1, in one embodiment the hinge mechanism 160 comprises a coupler lock 170 disposed along a hinge axis of rotation, R. The coupler lock has a hollow portion on at least one axial side and an interior wall disposed across the hollow portion and perpendicular to the axis of rotation. The hollow portion accommodates additional components when the hinge mechanism 160 is assembled, and the wall provides a surface against which an outward bias may be applied to the additional components.

Still referring to FIG. 1, among the additional components at least one cylindrical member 180 is disposed on one side of the coupler lock 170 along the rotational axis R of the hinge mechanism 160. The at least one cylindrical member 180 has splines 190 extending radially therefrom. In one embodiment, when the hinge mechanism is assembled the at least one cylindrical member 180 is biased outwardly along the rotational axis R, for example by the spring 200, to maintain interference of the splines 190 with the slots 145 of the at least one upper ring 125 and the at least one lower ring 135.

Embodiments of the hinge mechanism 160 that include the splines 190 for interference with the slots 145 may also be referred to as locking hinge mechanisms because they allow the hinge mechanism 160 to be locked so that the upper and lower housings 110, 120 are locked in a relative orientation, whether the carrying case 100 is open or closed. Alternative embodiments of the hinge mechanism 160 may lack the splines 190 on both ends or be comprised of a simple rod or the coupler lock 170 that spans the width of the carrying case 100 (or 300 described below) and that connects with the upper and lower housings 110, 120 allowing free relative rotation of the upper and lower housings 110, 120 around the hinge mechanism 160.

At least one button post 210 is disposed along the hinge rotational axis R on an exterior side of the at least one cylindrical member 180. In one embodiment the at least one button post 210 is connected to the at least one cylindrical member 180 by being disposed at least in part within the at least one cylindrical member 180. The at least one button post 210 may be connected to the at least one cylindrical member 180 for example without limitation, by an interference or press fit, by a snap fit, by an adhesive, or by any suitable method for connection as may be known in the art. When depressed by a user the at least one button post 210 is configured to push the at least one cylindrical member 180 inwardly along the hinge rotational axis R and against the outward bias applied to the at least one cylindrical member 180. When the one cylindrical member 180 is pushed sufficiently far enough by the at least one button post 210, the splines 190 are pushed free of the slots 145 partially disposed through the outermost of the at least one upper ring 125 or the at least one lower ring 135, thereby allowing the upper and lower housings 110, 120 to relatively rotate around the locking hinge mechanism 160.

Stated a different way, the button post 210 is configured to push the at least one cylindrical member 180 inwardly along the hinge rotational axis R and against the outward bias applied to the at least one cylindrical member 180 until the splines 190 are pushed free of the slots 145 of the at least one upper ring 125 or the at least one lower ring 135 disposed on at least one the upper and lower housings 110, 120. Partially disposing the slots 145 through the outermost of the at least one upper ring 125 or the at least one lower ring 135 is not only a part of a mechanism for releasing the locking hinge mechanism 160 but also provides outer axial support surfaces to contain the outwardly biased portions (for example the one or more cylindrical members 180) of the locking hinge mechanism 160.

Although two cylindrical members 180, two springs 200, and two button posts 210 are shown in FIG. 1, only one of each of these components is required for operation of the invention. In an embodiment having only one of each of these components, the side of the coupler lock 170 opposite the components may be a solid rod, or the coupler lock 170 may simply extend along the hinge mechanism 160, or any other component may be used that is suitable to allow the hinge mechanism 160 to extend across the width of the carrying case 100 and engage with the alternative rings or plates or other structure as may be known in the art as mentioned above on the upper and lower housings 110, 120 to allow relative rotation between the upper and lower housings 110, 120 around the hinge mechanism 160.

Figure 3:
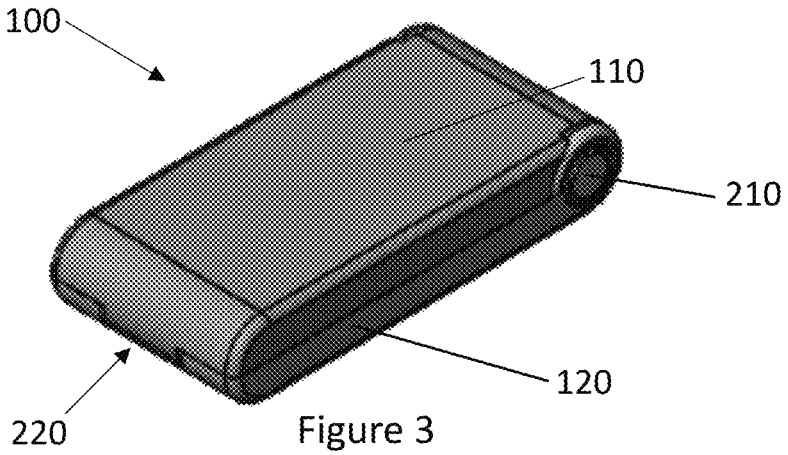
FIG. 3 is a perspective view of the first embodiment of the storage and carrying case in a closed configuration.

Referring to FIGS. 2 and 3, the embodiment of the storage and carrying case 100 is shown in an assembled state in an open configuration in FIG. 2 and a closed configuration in FIG. 3. In one embodiment, the carrying case 100 includes a closure 220 having a portion thereof disposed at an end of each of the upper and lower housings 110, 120 opposite the hinge mechanism 160. For example an upper closure portion 230 is disposed on the upper housing 110 and a lower closure portion 240 is disposed on the lower housing 120. The upper closure portion 230 and the lower closure portion 240 cooperate to hold the upper and lower housings 110, 120 closed against one another when the closure is closed. Closing force applied by the closure 220 in one embodiment compresses the sealing material 150 to ensure a strong seal is provided between the upper and lower housings 110, 120. Similarly, closing force applied by any embodiment of the locking hinge mechanism 160 described hereinabove may also compress the sealing material 150 to ensure a strong seal is provided between the upper and lower housings 110, 120. The closure 220 may be a tab (for example 230) that snaps into a groove (for example 240), or a tab that snaps into a slot, or a spring loaded or otherwise biased mechanism for engaging the two closure portions 230, 240, or any other suitable mechanism as may be known in the art.

Figure 4:
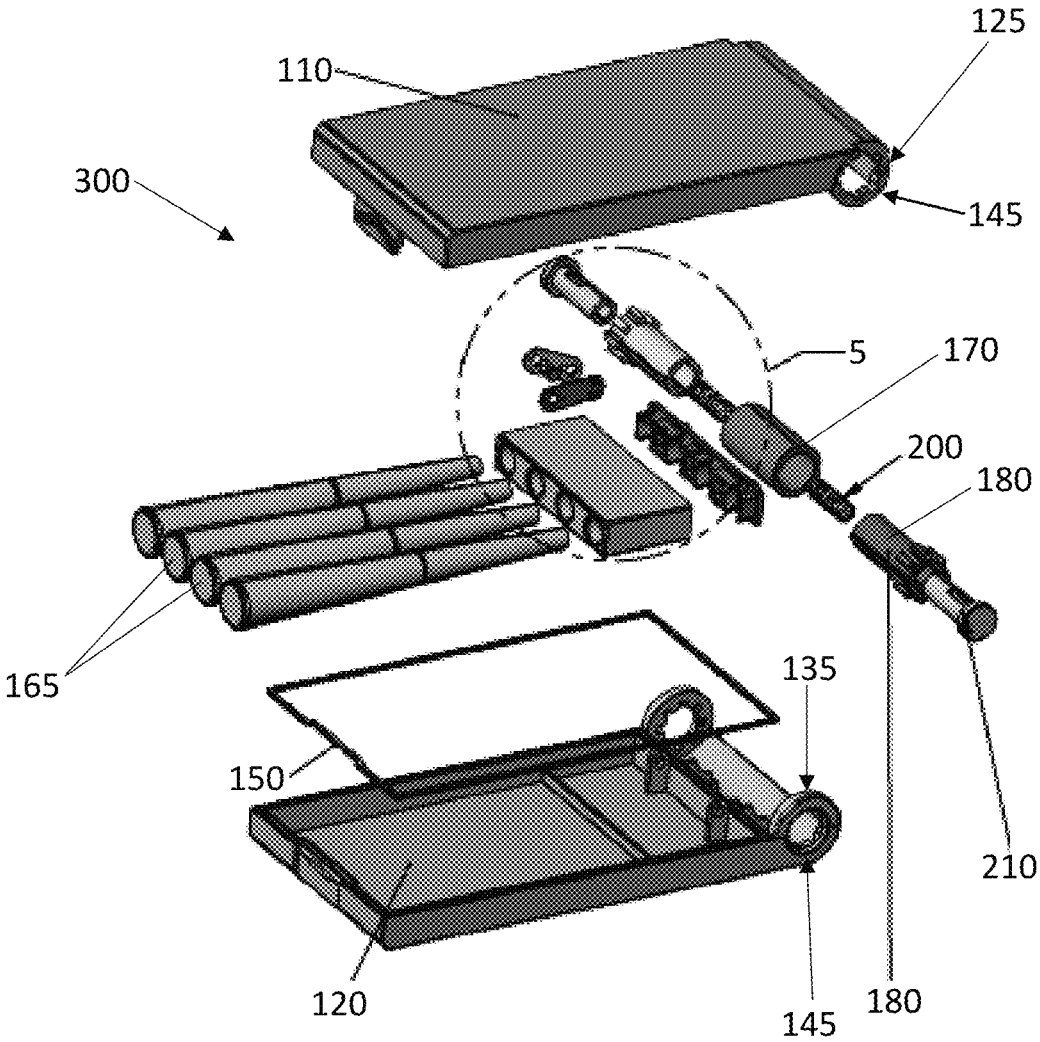
FIG. 4 is an exploded view of a second embodiment of a storage and carrying case.

An exploded view of a second embodiment of a storage and carrying case 300 is shown in FIG. 4. The carrying case 300 is similar to the carrying case 100 except for some differences as will be described hereinbelow. Components of the carrying case 300 given the same reference numeral as was provided hereinabove for components of the carrying case 100 are the same as the components of the carrying case 100 and are not described again. For example, referring to FIG. 4, all the numbered components starting with a 1 are the same as the same numbered components described hereinabove with regard to FIGS. 1-3. The upper and lower housings 110, 120 are the same in FIGS. 1 and 4 except for a slight difference in shape that is aesthetic and not relevant to the invention.

Figure 5:
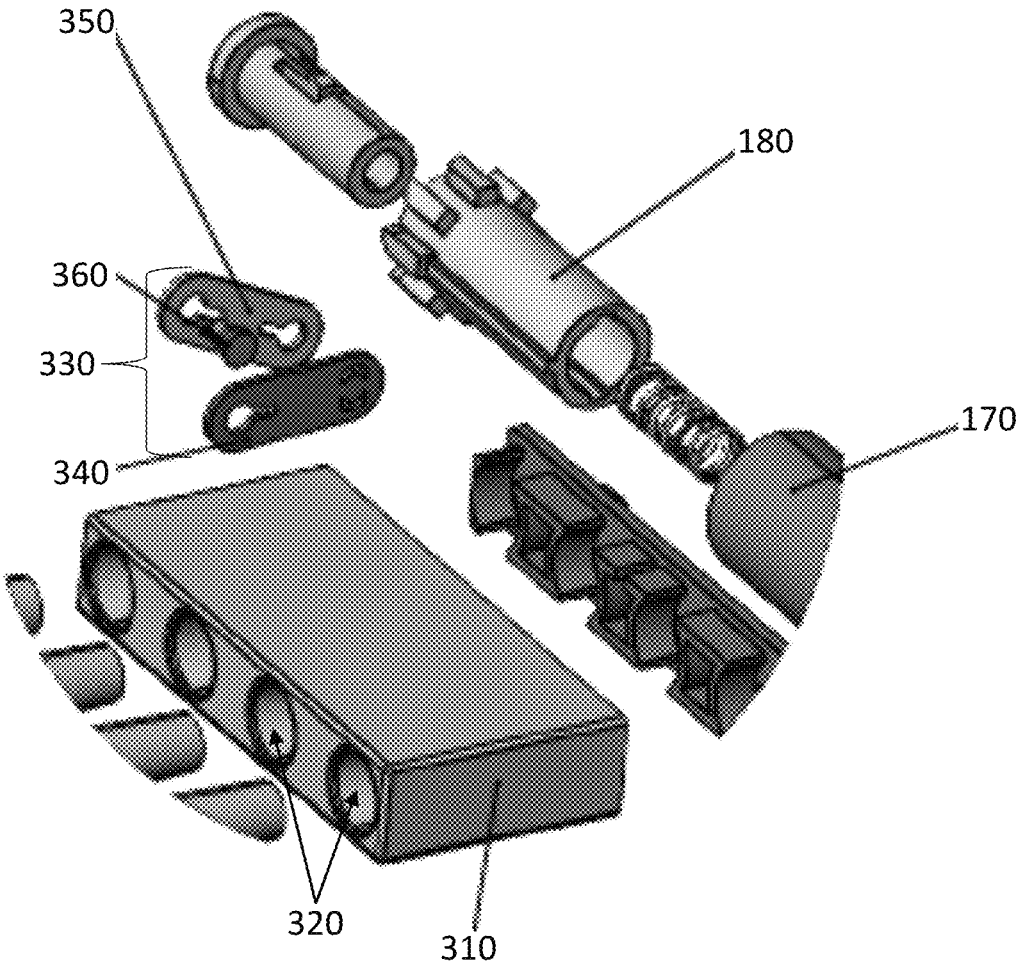
FIG. 5 is an enlarged view of the portion of FIG. 4 within the dashed circle 5.

A portion of FIG. 4 within the dashed circle 5 is shown somewhat enlarged in FIG. 5. Referring to FIGS. 4 and 5, in one embodiment a magazine 310 configured to support one or more item 165 is disposed within the carrying case 300. The magazine 310 is configured having a plurality of holes 320 that supports the one or more item 165 at an end of the one or more item.

Referring to FIG. 5, the magazine 310 in this embodiment is supported within the carrying case 300 by an internal hinge 330. The internal hinge 330 comprises first and second hinge members 340, 350. The first hinge member 340 is rotatably connected near a first end thereof to the magazine 310 and rotatably connected near a second end thereof to near a first end of the second hinge member 350. The second hinge member 350 is rotatably connected near a second end thereof to an interior surface of the upper housing 110 (see FIG. 6). The first and second hinge members 340, 350 are rotatably connected to one another and to the magazine 310 and to the interior surface of the upper housing 110, for example without limitation, by a pin or post 360, by a rivet, by a screw, or by any suitable rotatable connection as may be known in the art.

Figure 6:
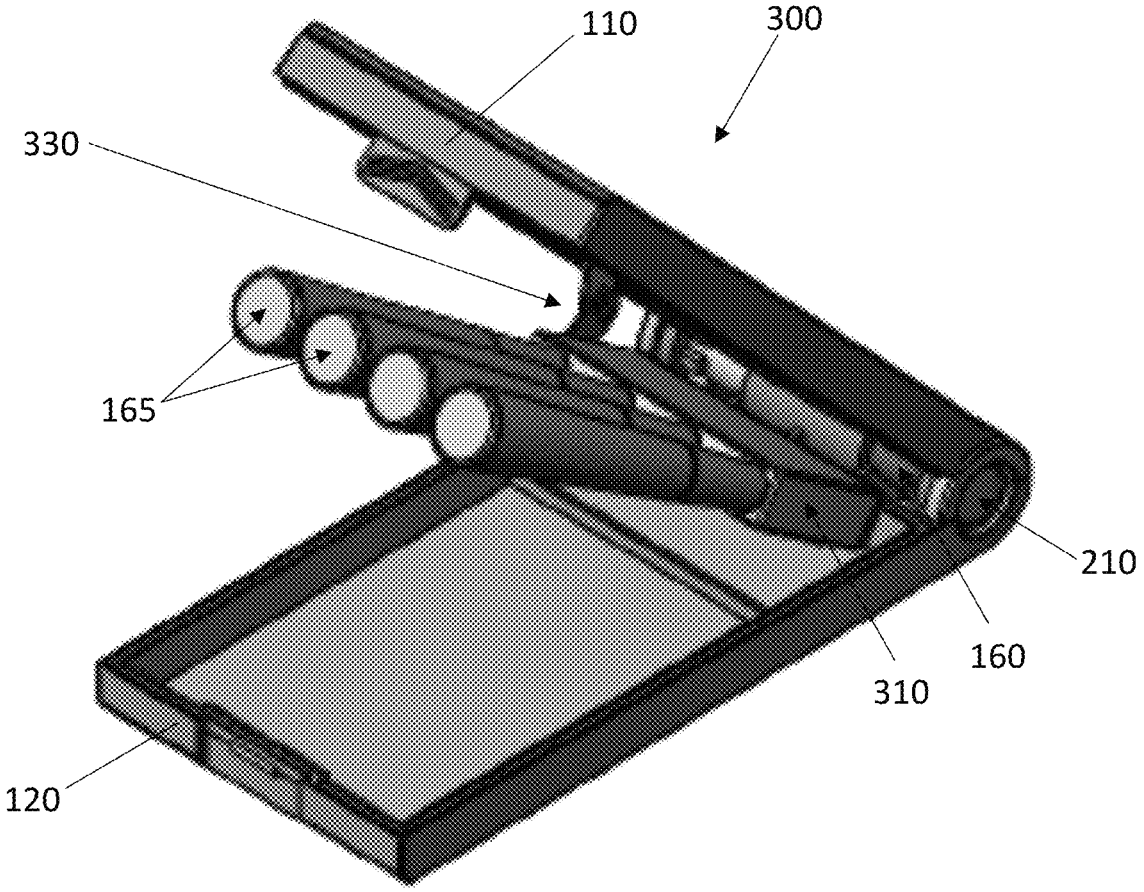
FIG. 6 is a perspective view of the second embodiment of the storage and carrying case in an open configuration.

Referring to FIG. 6, the carrying case 300 is shown in an assembled state in an open configuration. The upper housing 110 is rotated around the hinge mechanism 160 relative to the lower housing 120. Such rotation of the upper housing 110 tilts the magazine 310 upwardly relative to the lower housing 120 via the internal hinge 330.

When the upper housing 110 is closed onto the lower housing 120, the magazine 310 and the one or more item 165 supported by the magazine 310 are oriented flat along the bottom of the lower housing 120.

INDUSTRIAL APPLICABILITY

The storage and carrying case includes an upper housing and a lower housing connected by a hinge mechanism that may be a locking hinge mechanism. The locking hinge mechanism may be released by a pushbutton on a side of the storage and carrying case. The storage and carrying case may further include an internal magazine that supports one or more item. The storage and carrying case can be manufactured in industry for use by consumers.

Numerous modifications to the present invention will be apparent to those skilled in the art in view of the foregoing description. It is not desired to limit the invention to the exact construction and operation shown and described, and accordingly, all suitable modifications and equivalents may be resorted to, falling within the scope of the invention. Accordingly, this description is to be construed as illustrative only of the principles of the invention and is presented for the purpose of enabling those skilled in the art to make and use the invention and to teach the best mode of carrying out same. The exclusive rights to all modifications which come within the scope of the appended claims are reserved. All patents, patent publications and applications, and other references cited herein are incorporated by reference herein in their entirety.

We claim:

1. A storage and carrying case, comprising an upper housing and a lower housing connected by a locking hinge mechanism; wherein each of the upper and lower housings comprises at least one ring disposed at an end thereof and having slots disposed around an interior surface of the at least one ring;

the locking hinge mechanism comprises at least one cylindrical member disposed along a rotational axis of the locking hinge mechanism and having splines that interfere with the slots to prevent relative rotation of the upper and lower housings; and the at least one cylindrical member is biased outwardly along the rotational axis to maintain interference of the splines with the slots of the at least one ring on both the upper and lower housings.

2. The storage and carrying case of claim 1, wherein a button post is configured to push the at least one cylindrical member inwardly along the rotational axis against the outward bias until the splines are free of the slots of the at least one ring on at least one the upper and lower housings.

3. The storage and carrying case of claim 1, wherein a sealing material is disposed around a perimeter of an open side of at least one of the upper housing and the lower housing.

4. The storage and carrying case of claim 1, wherein a magazine is disposed within the carrying case, and wherein the magazine is adapted to support one or more items.

5. A storage and carrying case, comprising:

an upper housing and a lower housing connected by a locking hinge mechanism; and an internal magazine, that is adapted to support one or more items; wherein the locking hinge mechanism comprises at least one cylindrical member disposed along a rotational axis of the locking hinge mechanism and having splines that interfere with slots disposed on interior surfaces of at least one ring disposed on each of the upper and lower housings to prevent relative rotation of the upper and lower housings; and the at least one cylindrical member is biased outwardly along the rotational axis to maintain interference of the splines with the slots of the at least one ring on both the upper and lower housings.

6. The storage and carrying case of claim 5, wherein a button post is configured to push the at least one cylindrical member inwardly along the rotational axis against the outward bias until the splines are free of the slots of the at least one ring on at least one of the upper and lower housings.

7. The storage and carrying case of claim 5, wherein the internal magazine is configured having a plurality of elongate grooves adapted to support the one or more items along the length of the one or more items.

8. The storage and carrying case of claim 5, wherein the internal magazine is configured having a plurality of holes adapted to support the one or more items at an end of the one or more items.

9. The storage and carrying case of claim 8, wherein the internal magazine is supported within the carrying case by an internal hinge comprising:

first and second hinge members; wherein the first hinge member is rotatably connected near a first end thereof to the internal magazine and rotatably connected near a second end thereof to near a first end of the second hinge member; and the second hinge member is rotatably connected near a second end thereof to an interior surface of the upper housing.

10. The storage and carrying case of claim 5, further comprising:

a closure having a portion thereof disposed at an end of each of the upper and lower housings opposite the locking hinge mechanism;

wherein the portions of the closure cooperate to hold the upper and lower housings closed against one another when the closure is closed; and wherein a sealing material is disposed around a perimeter of an open side of at least one of the upper housing and the lower housing.

* * * * *